United States Patent [19]

Hillbish

[11] Patent Number: 4,702,707

[45] Date of Patent: Oct. 27, 1987

[54] POWER CONTACT HAVING REMOVABLE MATING COMPONENTS

[75] Inventor: Warren C. Hillbish, Hummelstown, Pa.

[73] Assignee: AMP Incorporated, Harrisburg, Pa.

[21] Appl. No.: 897,188

[22] Filed: Aug. 15, 1986

[51] Int. Cl.[4] ..... H01R 9/09

[52] U.S. Cl. ..... 439/80; 439/745

[58] Field of Search ..... 339/14 R, 17 R, 17 C, 339/17 LC, 17 L, 186 R, 186 M, 217 R, 217 J, 219 R, 258 R, 262 R, 262 P, 143 R, 92 R, 92 M; 411/402–419

[56] References Cited

U.S. PATENT DOCUMENTS 4,518,209 5/1985 Negley ..... 339/17 L C

*Primary Examiner*—Neil Abrams

*Attorney, Agent, or Firm*—Allan B. Osborne

[57] ABSTRACT

A power contact having a mating component removably mounted in a base. More particularly, the mating component includes a stem with a mating socket at one end and a threaded portion at another end which is threaded into one opening of a bore extending through the base. A screwdriver slot at the end face of the threaded portion is accessible through the other opening to the bore to remove and replace the mating component.

2 Claims, 4 Drawing Figures

10
14
30
16
18
22
24
52
72
71
32
50
20
48
34
35
58
40
46
44
36
26
28

POWER CONTACT HAVING REMOVABLE MATING COMPONENTS

FIELD OF THE INVENTION

The present invention relates to power contacts with mating components positioned in connectors and where both the power contacts and the connectors have leads or pins for soldering to printed circuit boards or back planes.

BACKGROUND OF THE INVENTION

Some high density and eurocard connectors of the type having signal contacts therein with outwardly extending pins which are soldered into plated-through holes in a printed circuit board also include prior art power contacts with outwardly extending pins which are soldered into plated-through holes in the board for electrical connection to power circuits thereon. Further, the prior art power contacts included a non-removable, mating pin or socket, extending through the housing of the connector for electrical engagement with a complementary power contact positioned in a mating connector. In the event the mating component of the power contact became damaged during mating of the connectors, it was necessary to desolder the entire connector along with the power contact in order to replace the power contact.

It is now proposed to provide a power contact having a removable mating component thereon so that a damaged component can be replaced without the need to desolder and remove the entire connector and power contact from the board.

SUMMARY OF THE INVENTION

According to the present invention, the power contact is provided having a base with a threaded bore opening out onto opposing surfaces and terminal pins for being soldered in holes in a printed circuit board for electrical engagement with power circuits thereon. Further, the power contact includes a mating component for being disposed in a connector mounted on the printed circuit board immediately next to the base. The mating component includes a mating end for electrical engagement with complementary mating ends on other power contacts or the like and a threaded portion on the other end for being threadedly received in one opening in the bore. A screwdriver receiving slot in the end face of the threaded portion permits removing and replacing the mating component from the base by a screwdriver inserted into the bore from the other opening.

DESCRIPTION OF THE INVENTION

Figure 1:
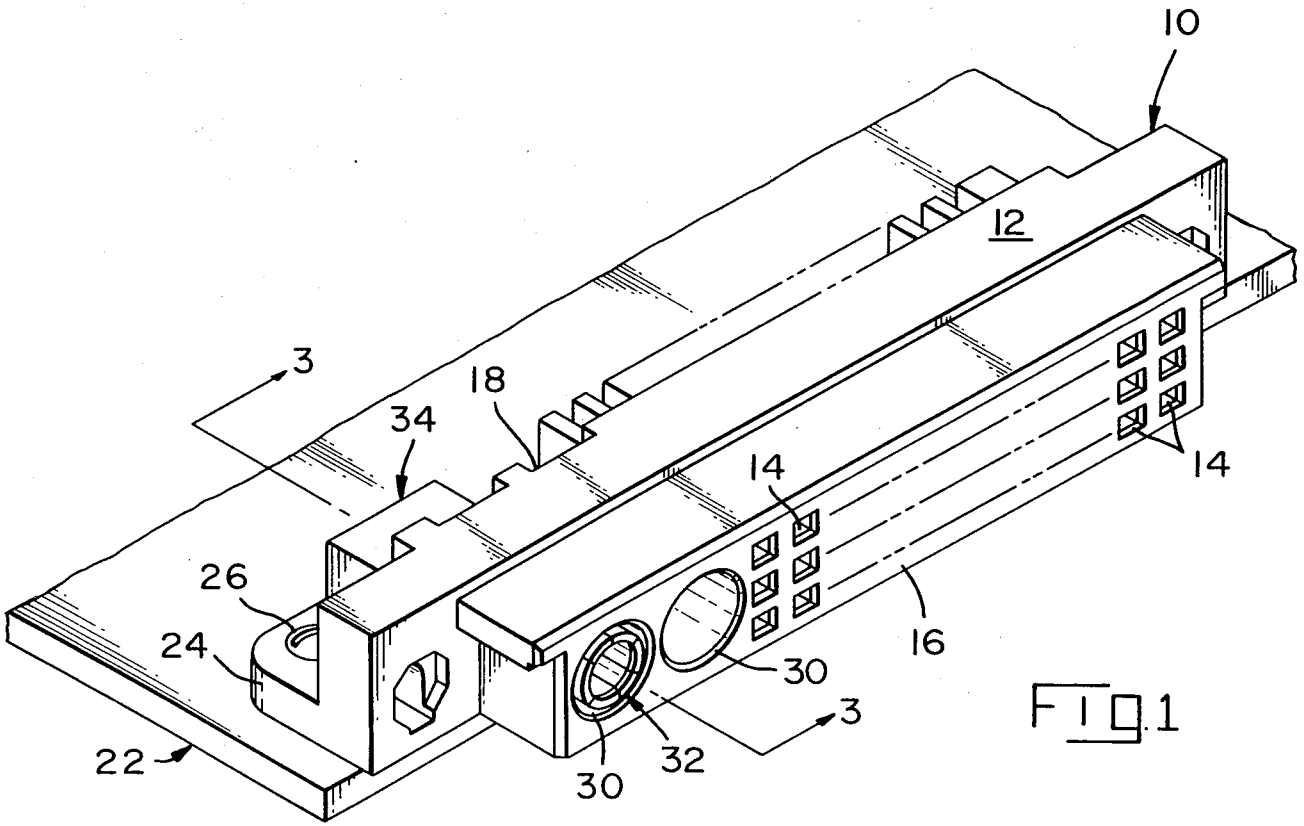
FIG. 1 is a perspective view of a high density connector with a power contact of the present invention soldered to a printed circuit board.
Figure 4:
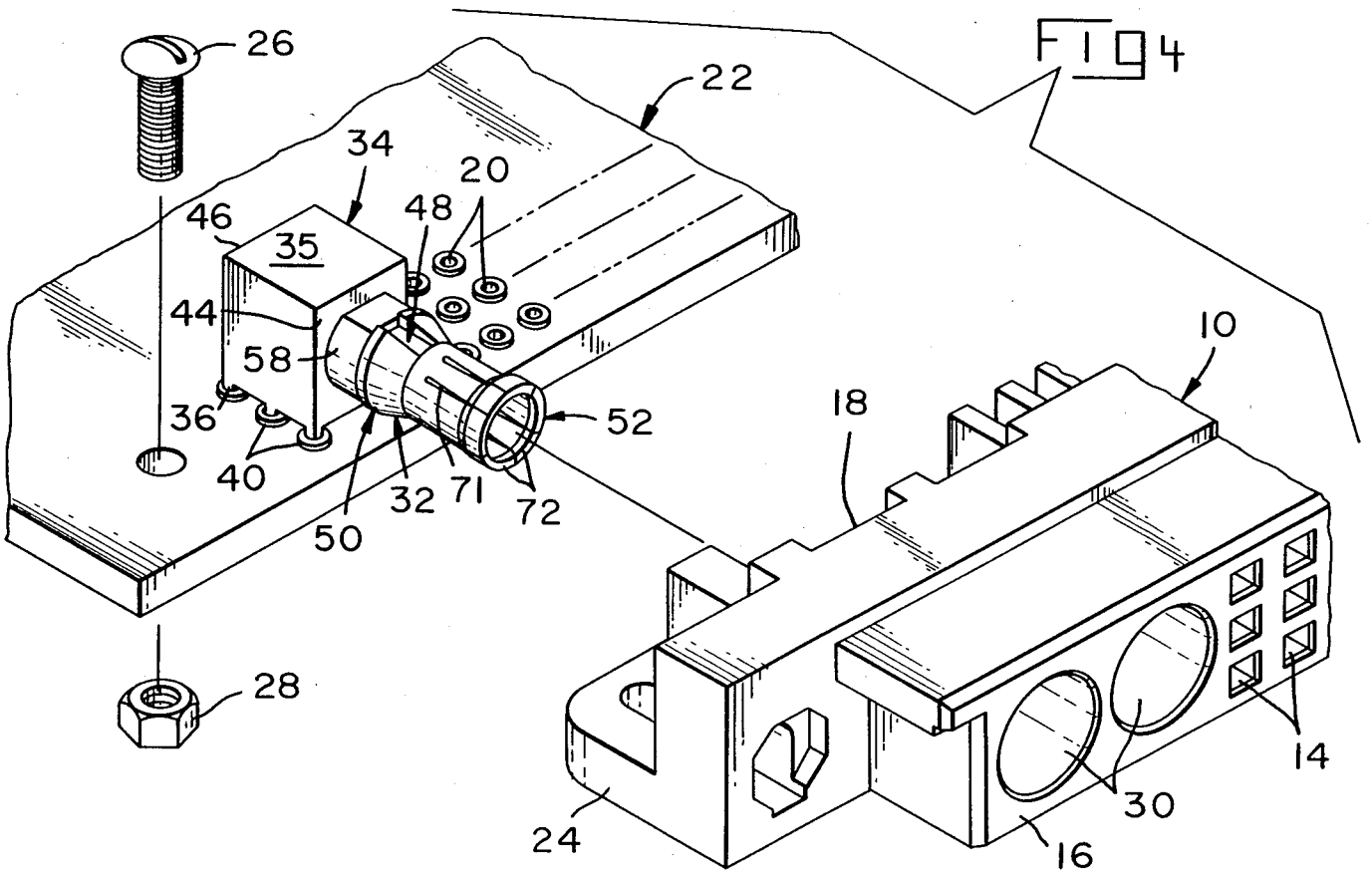
FIG. 4 is a perspective view of the power contact mounted on the printed circuit board with the connector exploded therefrom.

As shown in FIG. 1, high density connector 10 includes a dielectric housing 12 with a plurality of cavities 14 opening onto front surface 16 and rear surface 18. A plurality of box receptacle contact elements (not shown) are positioned in cavities 14 with terminal pins extending out from rear surface 18 and down into plated-through holes 20 (FIG. 4) in printed circuit board 22 where they are soldered for electrical engagement with signal circuits (not shown) on board 22. Connector 10 further includes mounting ears 24 through which bolt 26 extends to mechanically secure connector 10 to board 22 by means of nut 28 (FIG. 4).

Figure 3:
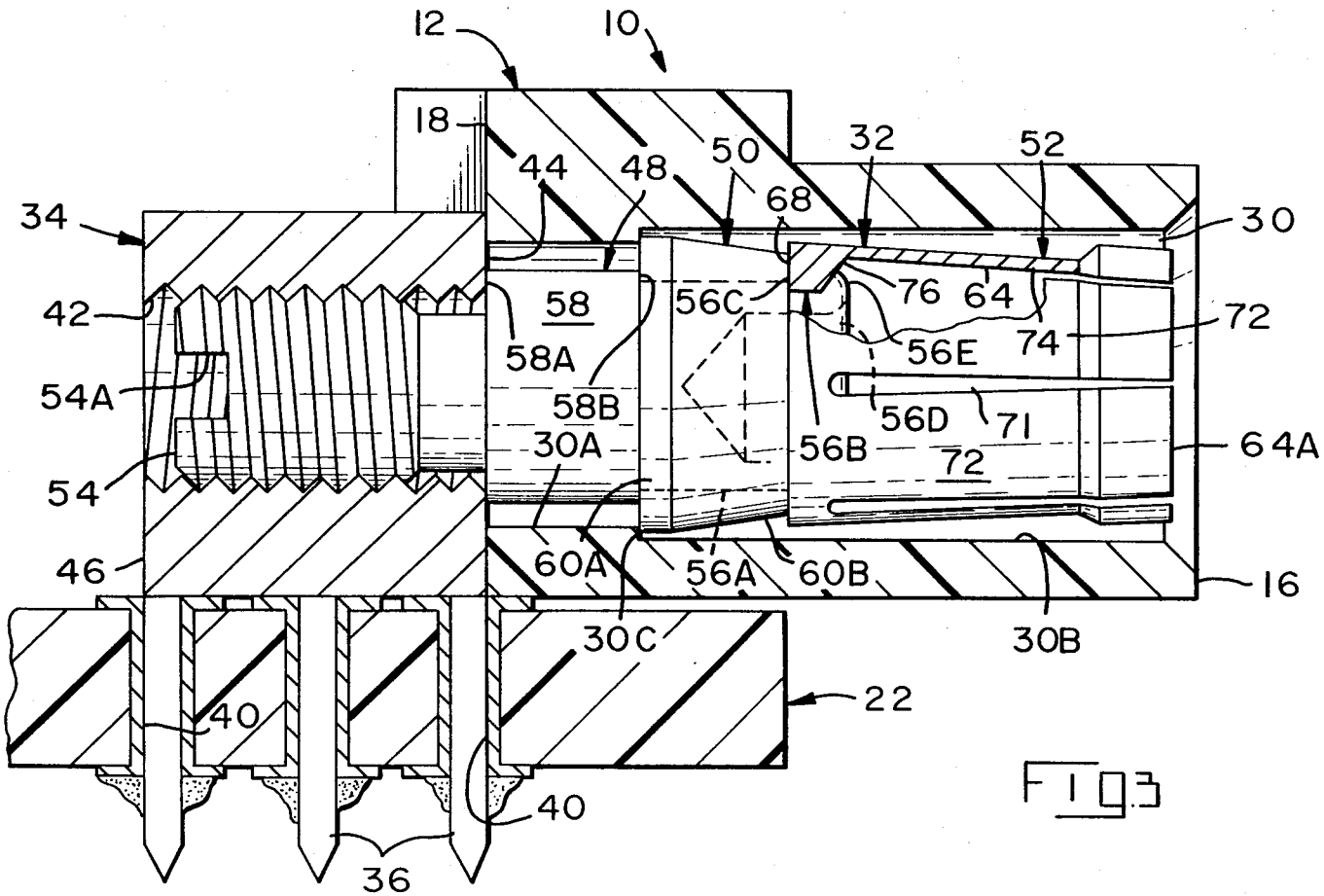
FIG. 3 is a cross-sectional view, taken on line 3—3 in FIG. 1, of the connector and power contact mounted on the printed circuit board.

Power passages 30, singularly or in multiples, are provided in housing 12 to receive mating component 32 of power contacts 34. As shown in FIG. 3, passage 30 includes a smaller diameter portion 30A opening onto rear surface 18 of housing 12 and a larger diameter portion 30B opening onto front surface 16 of housing 12. Shoulder 30C within passage 30 faces towards front surface 16.

Figure 2:
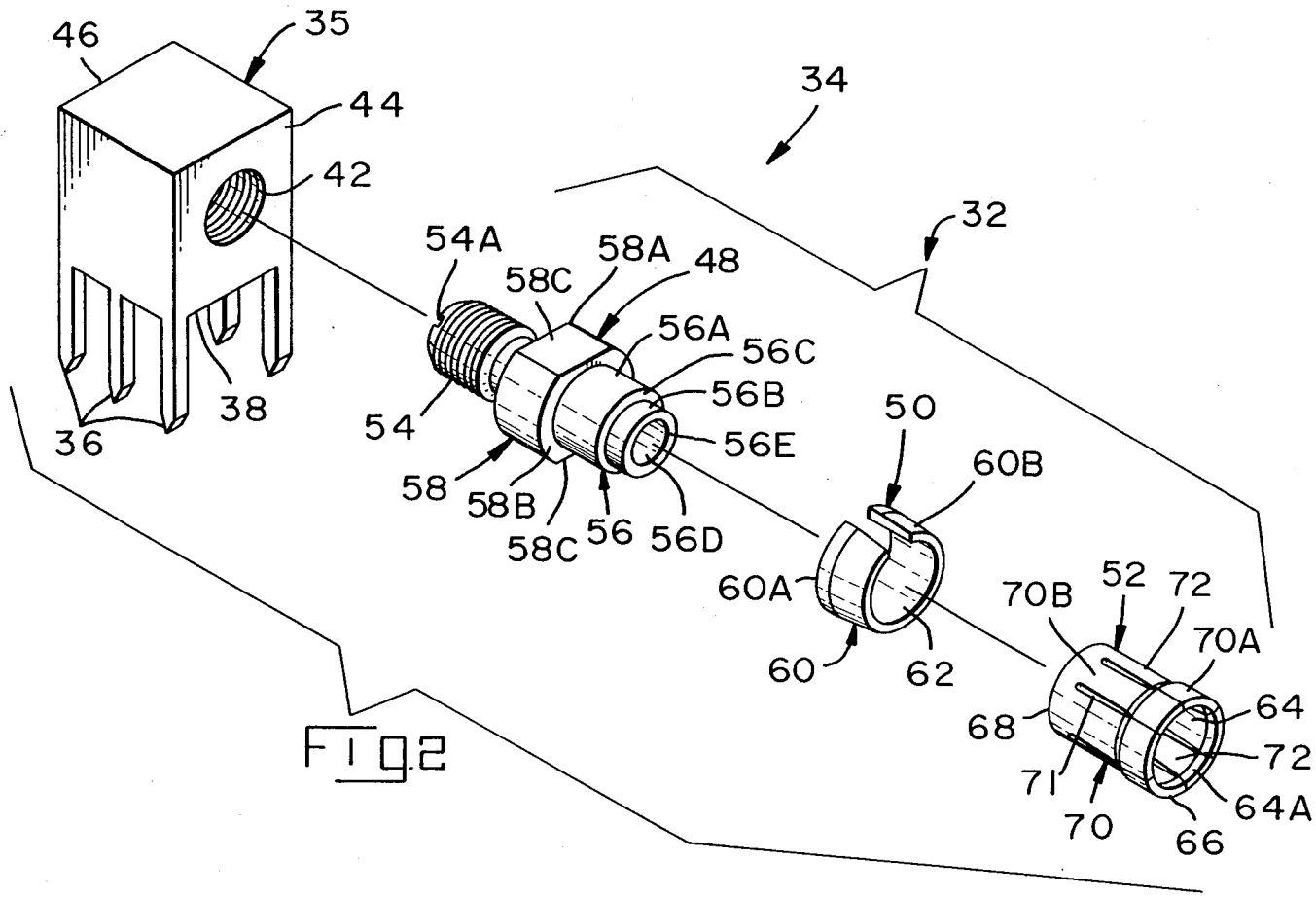
FIG. 2 is an exploded perspective view of the power contact.

With reference to FIG. 2, power contact 34 includes the aforementioned mating component 32 and base 35.

Base 35 is a machined block with the preferred material being a copper alloy and finished with a gold flash or other suitable plating. Terminal pins 36, six being provided on the embodiment shown, extend outwardly from opposing edges of surface 38. Terminal pins 36 are adapted for insertion and soldering in plated through holes 40 (FIGS. 3, 4) in board 22 for electrical engagement with power circuits (not shown) thereon. Threaded bore 42 extends through base 35, opening onto opposing surfaces, 44, 46.

Mating component 32 includes stem 48, split collar 50 and socket 52.

Stem 48 is made from brass and finished with a gold flash. End section 54 thereon is threaded for threaded engagement with bore 42 in base 34 and includes slot 54A at the end face thereof. Opposing end section 56 includes a first cylindrical portion 56A, a smaller diameter, second cylindrical portion 56B and shoulder 56C therebetween and facing outwardly. Aperture 56D is provided in portion 56B, opening onto end face 56E. Center section 58, positioned between end sections 54, 56, is larger in diameter relative to the other structural elements of stem 48. Center section 58 provides shoulders 58A, 58B facing in opposite directions. Opposing flats 58C are provided on center section 58 for use in tightening component 32 onto base 34 by a wrench (not shown).

Split collar 50 is made from phosphor bronze and nickel plated. Outer surface 60 includes a short portion 60A which is parallel to inner surface 62, and a tapered portion 60B with the taper being away from portion 60A.

Cylindrical socket 52 is machined or drawn with the preferred material being beryllium copper and the finish being gold over nickel. Passage 64, having a funnel entrance 64A, opens out at front and rear faces 66, 68 respectively of socket 52. The outer surface 70 includes front portion 70A and rear portion 70B which converges inwardly from rear face 68 to front portion 70A. Slits 71 in socket 52, extending longitudinally from front face 66 towards rear face 68, define a plurality of spring fingers 72.

As shown in FIG. 3, wall 74 of socket 52 thickens inwardly adjacent rear face 68 to provide an interior slanting annular shoulder 76 which faces towards passage entrance 64A.

Socket 52 mates with a complementary pin (not shown) on a like power contact or otherwise. As is apparent to those skilled in the art, socket 52 could be replaced with some other mating means; e.g., the aforementioned pin, a tab terminal and so forth.

In assembling power contact 34, collar 50 is placed around first cylindrical portion 56A with the tapered portion 60B of outer surface 60 facing away from shoulder 58B of center section 58. Socket 52 is placed onto second cylindrical portion 56B with rear face 68 abutting shoulder 56C and secured thereon by upsetting end face 56E over onto interior shoulder 76 in passage 64 in socket 52 as shown in FIG. 3. Base 35 is added by threading end section 54 of stem 48 of component 32 into bore 42 until shoulder 58A on center section 58 abuts surface 44.

With reference to FIGS. 3 and 4, power contact 34 is added to connector 10 by inserting mating component 32 into passage 30 of housing 12 from rear surface 18. During insertion, split collar 50 compresses while passing through narrow passage portion 30A and recovers after passing shoulder 30C. With surface 44 on base 35 abutting rear surface 18 on connector housing 12 and collar 50 abutting shoulder 30C, power contact 34 is now locked into housing 12 but can be removed by inserting a collar compressing tool (not shown) up onto tapered portion 60B to compress collar 50 so that contact 34 can be withdrawn rearwardly. However, once connector 10 and power contact 34 are soldered onto circuit board 22, neither can be separated from the other by that method without desoldering.

With respect to power contact 34 of the present invention, in the event socket 52 becomes damaged, with a screwdriver, (not shown) engaging slot 54A from rear surface 46 of base 35, component 32 can be untreaded and withdrawn from front surface 16 of connector 10. A new component 32 can then be inserted into passage 30 from front surface 16 and threaded into base 35 again by use of the screwdriver.

Although slot 54A has been illustrated as preferred, other tool receiving means could be used; e.g. a hexagonal opening (not shown) for an Allen wrench.

As can be discerned, a power contact, for use with connectors mounted on printed circuit boards, having a mating component which can be replaced without desoldering the contact and connector from the board has been disclosed. The power contact includes a base having a threaded bore extending therethrough and terminal pins for being soldered in holes in the circuit board for electrical engagement with power circuits thereon. The power contact further includes a mating component for positioning in a passage in the connector and having a threaded end for removable engagement with the bore in the base and a socket at the other end for mating with a complementary power pin. A damaged component can be removed by being unthreaded by a screwdriver inserted into the bore at the back of the base and withdrawn from the front of the connector. A new component can be inserted into the connector from the front and threaded into the bore in the base in the same manner.

I claim:

1. A power contact for use with connectors mounted on printed circuit boards, comprising:

conductive base means having a threaded bore extending therethrough and opening onto opposing surfaces and further having terminal means extending outwardly therefrom for being electrically attached to circuits on the printed circuit board, said base means being adapted to be positioned adjacent to a connector having a passage therethrough with said threaded bore being coaxial with said passage; and a conductive mating component including elongated stem means with mating means at one end adapted to be disposed in said passage in said connector and a threaded portion at another end with tool receiving means at the free face thereof, said threaded portion being received through one opening in said threaded bore in said base means with said tool receiving means being accessible through the other opening for receiving a tool for unthreading said mating component from said threaded bore to enable removing and replacing the mating component without moving said base means or connector adjacent to which said base means may be positioned.

2. The power contact of claim 1 further including securing means on said mating component for removably securing said mating component in a passage in the connector.

* * * * *